US005853188A

United States Patent [19]

Alden

[11] Patent Number: 5,853,188

[45] **Date of Patent: *Dec. 29, 1998**

[54] STRAPLESS BOOT BINDING FOR SNOWBOARDS

[75] Inventor: Richard P. Alden, Morrison, Colo.

[73] Assignee: Ride, Inc., Preston, Wash.

[ * ] Notice: The term of this patent shall not extend beyond the expiration date of Pat. No. 5,660,410.

[21] Appl. No.: 932,266

[22] Filed: Sep. 17, 1997

Related U.S. Application Data

[63] Continuation-in-part of Ser. No. 780,414, Jan. 7, 1997, which is a continuation of Ser. No. 397,670, Mar. 2, 1995, Pat. No. 5,660,410, which is a continuation-in-part of Ser. No. 352,368, Dec. 9, 1994, abandoned.

[51] Int. Cl.[6] ..... A63C 9/18

[52] U.S. Cl. ..... 280/627; 280/613; 280/617; 280/14.2

[58] Field of Search ..... 280/613, 614, 280/618, 626, 631, 627, 14.2, 617

[56] References Cited

U.S. PATENT DOCUMENTS

| | | | |
|---|---|---|---|
| 3,003,777 | 10/1961 | Hilding | 280/614 |
| 3,771,806 | 11/1973 | Hinterholzer et al. | 280/613 |
| 3,785,668 | 1/1974 | Marker | 280/613 |
| 4,512,594 | 4/1985 | Eyre | 280/614 |
| 5,344,179 | 9/1994 | Fritschi et al. | 280/618 |
| 5,544,909 | 8/1996 | Laughlin et al. | 280/14.2 X |

FOREIGN PATENT DOCUMENTS

| | | | |
|---|---|---|---|
| 2652753 | 4/1991 | France | 280/14.2 |
| 678397 | 9/1991 | Switzerland | 280/14.2 |

*Primary Examiner*—J. J. Swann
*Assistant Examiner*—Michael Mar
*Attorney, Agent, or Firm*—Douglas W. Swartz; Sheridan Ross P.C.

[57] ABSTRACT

The present invention is directed to a step-in, strapless snowboard binding. The snowboard binding is particularly useful for soft-shelled boots. The snowboard binding includes a receiving member and a locking member which move relative to one another to lock or unlock the boot relative to the binding. The receiving member has a motion control surface corresponding to each of a plurality of boot binding positions. The locking member engages a selected one of the control surfaces to lock the heel of the boot near a surface of the snowboard if snow is between the bottom of the heel and the surface. The locking member engages a different one of the control surfaces to lock the heel on the surface if there is no snow between the bottom and the surface.

12 Claims, 10 Drawing Sheets

STRAPLESS BOOT BINDING FOR SNOWBOARDS

The present application is a continuation-in-part of co-pending U.S. patent application Ser. No. 08/780,414 for "Strapless Boot Binding for Snowboards" filed Jan. 7, 1997, incorporated herein by this reference in its entirety, which was a continuation of U.S. patent application Ser. No. 08/397,670 for "Strapless Boot Binding For Snowboards" filed on Mar. 2, 1995, now U.S. Pat. No. 5,660,410, incorporated herein by this reference in its entirety, and which was a continuation-in-part of U.S. patent application Ser. No. 08/352,368 for "RPA Strapless, Step-In, Snowboard Boot & Binding System" filed Dec. 9, 1994, incorporated herein by this reference in its entirety, now abandoned.

FIELD OF THE INVENTION

The present invention relates generally to a binding for snowboards and more specifically to a strapless, step-in boot binding for snowboards, wherein the binding locks the boot to the snowboard notwithstanding the presence of a thin layer of snow between the heel of the boot and the snowboard.

BACKGROUND OF THE INVENTION

Snowboarding has become a popular winter sport. In snowboarding, bindings secure a snowboarder's boots to a snowboard. A snowboard is a monolithic board, similar to a surfboard. Snowboarders generally prefer soft-shelled boots over hard-shelled boots, such as ski-boots, as they provide a greater freedom of movement. The soft-shelled boots are typically secured to the binding by one or more adjustable retaining straps extending over the top of the boot. A snowboarder connects the retaining straps by sitting down in the snow and bending over and ratcheting the straps tightly over the top of the boot. Because of the substantial length of conventional ski bindings which causes the bindings to extend over one or more sides of the snowboard, releasable bindings such as those used in skiing, have been found to be generally unsuitable for snowboarding.

The unique configuration of the snowboard creates many problems in mounting and dismounting chair lifts. To mount a chair, a snowboarder must bend over, disengage a leg from the binding and use the free leg to push himself into position in front of the chair. Retaining straps frequently become brittle and break from being repeatedly engaged and disengaged and/or from accidental contact with skiers or other snowboarders in the lift line. Unlike skiers, snowboarders cannot use poles to push themselves into a position to mount the chair.

Additional problems arise when the snowboarder turns or stops on the ski slope. During turns, the restraining straps can bunch up at the ankle, creating pain and discomfort. If the snowboarder stops on the slope, particularly for shallow declines, the snowboarder generally must push himself with a free leg to a steeper incline and then lean over and secure the free leg in the binding by connecting the retaining straps. Securing the free foot in the binding, is an extremely inconvenient procedure.

Also, problems arise when the snow becomes adhered to the sole of the boot, such as bottom of the heel of the boot. For example, the binding may not completely secure the boot to the binding, or the binding may become loose if such snow melts or becomes compressed during snowboarding.

SUMMARY OF THE INVENTION

It is an objective of the present invention to provide a binding that does not require retaining straps to secure the boot to the binding. It is a related objective to provide a step-in binding.

It is a further objective to provide a binding for soft-shelled or hard-shelled boots that is easy to disengage from the boots. It is a related objective to provide a binding for soft-shelled or hard-shelled boots that has a quick, manual release capability. "Manual Release" refers to the disengagement of the boot from the binding by hand.

It is a further objective to provide a binding that is not automatically releasable from the snowboard upon impact.

It is a still further objective of the present invention to provide a heel binding that will latch and retain the heel releasably secured to the snowboard even though there is a layer of snow between the bottom of the boot and the upper surface of the snowboard.

These and other objectives are realized by the present invention. In a first embodiment, the present invention provides a snowboard binding system including: (i) a front member; (ii) a device on said front member for engaging the front portion of a boot; (iii) a rear member; and (iv) a device on the rear member for holding the rear portion of the boot. The device for engaging the rear portion of the boot is located at least about 1.5 inches above the top surface of the snowboard to reduce the possibility of the snowboard binding system contacting the snow during edging or turning of the snowboard. The device for engaging the rear portion of the boot releasably engages a structural member on the rear portion of the boot to hold the boot in position.

The device for engaging the rear portion of the boot can include a receiving member for engaging the structural member of the boot, and a locking member. The locking member engages the receiving member to lock the boot in the binding system and disengages from the receiving member to release the boot from the binding system. The receiving member and the locking member are preferably rotatably engaged on the rear member of the binding system. The receiving member is provided with at least two notches on a notched end, with each such notch being at a different angular position relative to the axis of rotation of the receiving member. Depending on the amount of snow, if any, between the upper surface of the snowboard and the bottom of the boot, the locking member engages either one or the other of the at least two notches to releasably lock the boot in the binding system.

The binding system preferably has no fasteners, such as retaining straps, located on the front of the boot. All fasteners connecting the boot to the binding system are preferably located either on the rear or bottom of the boot.

To accommodate boots of different sizes, the relative positions of the front or rear members can be altered. For example, the front and rear members can be detached from one another and/or the front or rear member can slidably engage another member that is fixed to the snowboard to provide for convenient adjustment.

In another embodiment, the present invention provides a snowboard binding system having which includes: (i) a front member; (ii) a rear member (iii) a device, located on the front member for holding the front portion of the boot, and (d) a device, located on the rear member, for holding the rear portion of the boot. The device on the front member connects to a structural member on the bottom of the boot to hold the boot in position.

The structural member on the boot can be a hooked member with the open end of the hooked member facing towards the front end of the boot. The device for holding the front portion of the boot can include a rod to engage the hooked member.

In yet another embodiment, the present invention provides a snowboard binding system, including a holding member for receiving a boot, which includes (i) a front member; (ii) an arcuate rear member; (iii) a device, located on the front member, for holding the front portion of the boot; and (iv) a rear binding device, rotatably mounted on the arcuate rear member, for holding the rear portion of the boot. The rear binding device for holding the rear portion of the boot connects to a structural member of the boot. The rear binding device is located above the heel of the sole of the boot to reduce the likelihood of the binding system contacting the snow during edging or turning.

In the rear binding device on the arcuate rear member, there may be a receiving member having an upwardly open slot to receive the structural member of the boot when the heel of the boot is moved toward the upper surface of the snowboard. After a minimum amount of such movement, the slot of the receiving member releasably captures the structural member, preventing it from moving out of such slot. A locking member is mounted for rotation on the arcuate rear member and engages the receiving member to releasably lock the boot in position and disengages from the receiving member to release the boot. The engagement of the locking member and the receiving member is between an extension of the locking member and one of a series of notches on a notched end of the receiving member. A first of such notches is engaged by the extension upon such minimum amount of such movement of the boot toward the snowboard. Upon occurrence of a further amount of such movement of the heel of the boot toward the upper surface of the snowboard, the receiving member rotates further and continues to capture the structural member. The extension engages the second notch of the series and in a similar manner releasably prevents reverse rotation of the receiving member, which releasably locks the boot in snowboarding position on the snowboard.

In yet another embodiment, the present invention includes a boot for engaging a snowboard binding, including: (i) a boot shell; (ii) a sole attached to the boot shell; and (iii) a projection extending from the rear of the boot shell for engaging the snowboard binding. The boot can include a hooked member on the sole for engaging the snowboard binding.

In yet another embodiment, a method is provided for engaging a boot with a snowboard binding, including the steps of: (i) first engaging a first structural member on the bottom of a boot with a restraining member on a snowboard binding; (ii) second engaging a second structural member on the boot with a receiving member on the snowboard binding; and (iii) placing the receiving member in one of a series of locked positions. The particular locked position that is used depends, for example, on the thickness of a layer of snow that may be between the bottom of the heel of the boot and the upper surface of the snowboard.

The process can include additional steps, such as rotating the receiving member into a locked position and engaging the receiving member with a locking member on the snowboard binding to place the receiving member into a locked position.

To release the boot from the binding, the locking member is rotated to disengage the locking member from the receiving member and the boot is removed from the snowboard binding.

The strapless, step-in binding system of the present invention is applicable to soft-and hard-shelled boots and eliminates many of the problems in existing snowboard bindings. For example, the present invention provides for a quick and convenient method to mount and manually release a boot from a binding system, thereby facilitating mounting ski chairs and reducing pain and discomfort associated with maneuvering snowboards using existing snowboard bindings.

DETAILED DESCRIPTION

Figure 1:
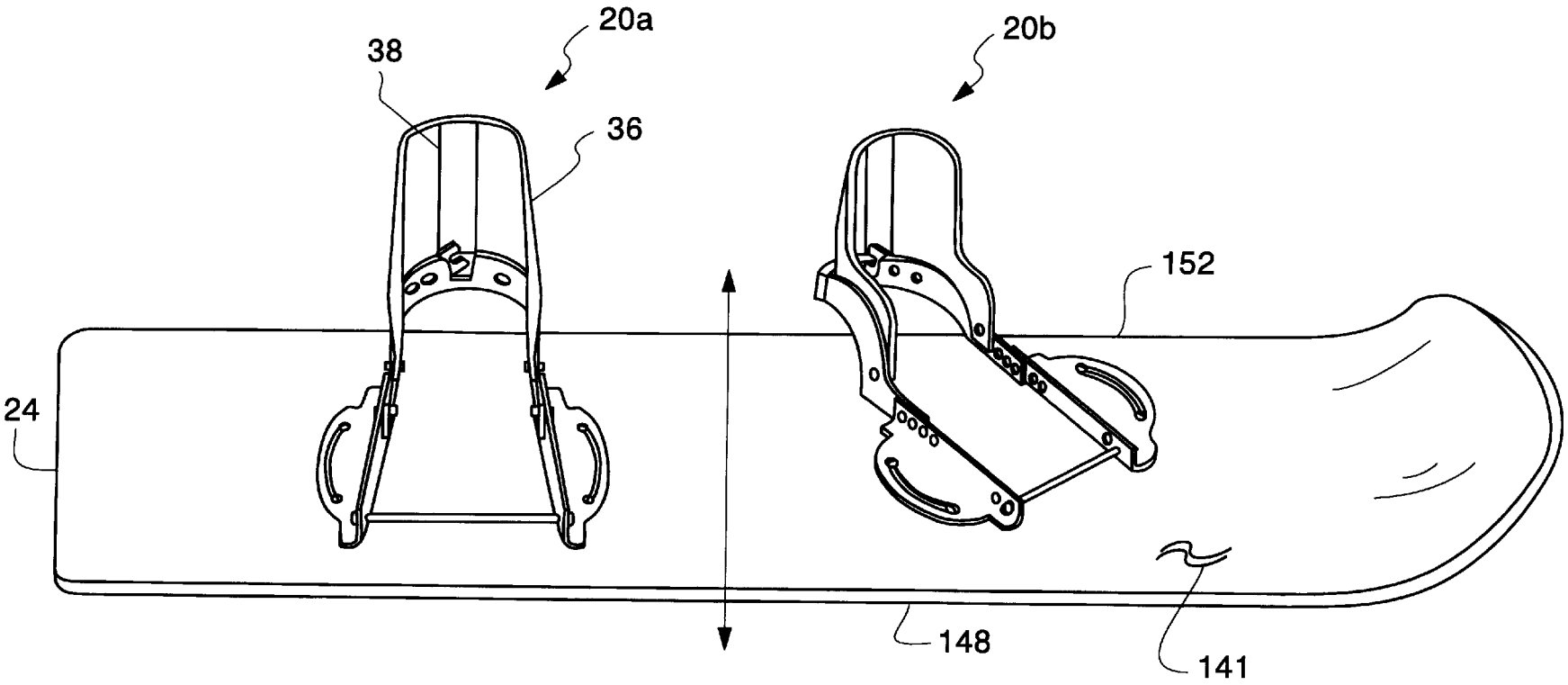
FIG. 1 is a view of an embodiment of the snowboard bindings of the present invention mounted on a snowboard.

A preferred embodiment of the present invention is illustrated in FIG. 1. Two snowboard bindings 20*a* and 20*b* are mounted at respective rear and forward locations on a snowboard 24. The orientation of the snowboard bindings 20*a* and 20*b* relative to the longitudinal axis of the snowboard 24 is determined by the preference of the snowboarder. Generally, the rear snowboard binding 20*a* is normal to the latitudinal axis of the snowboard and the front snowboard binding 20*b* is at an angle, less than 60 degrees relative to the snowboard axis. Because the two snowboard bindings 20*a* and 20*b* have substantially the same construction, for ease of explanation only the rear snowboard binding 20*a* will be described in detail.

Figure 2:
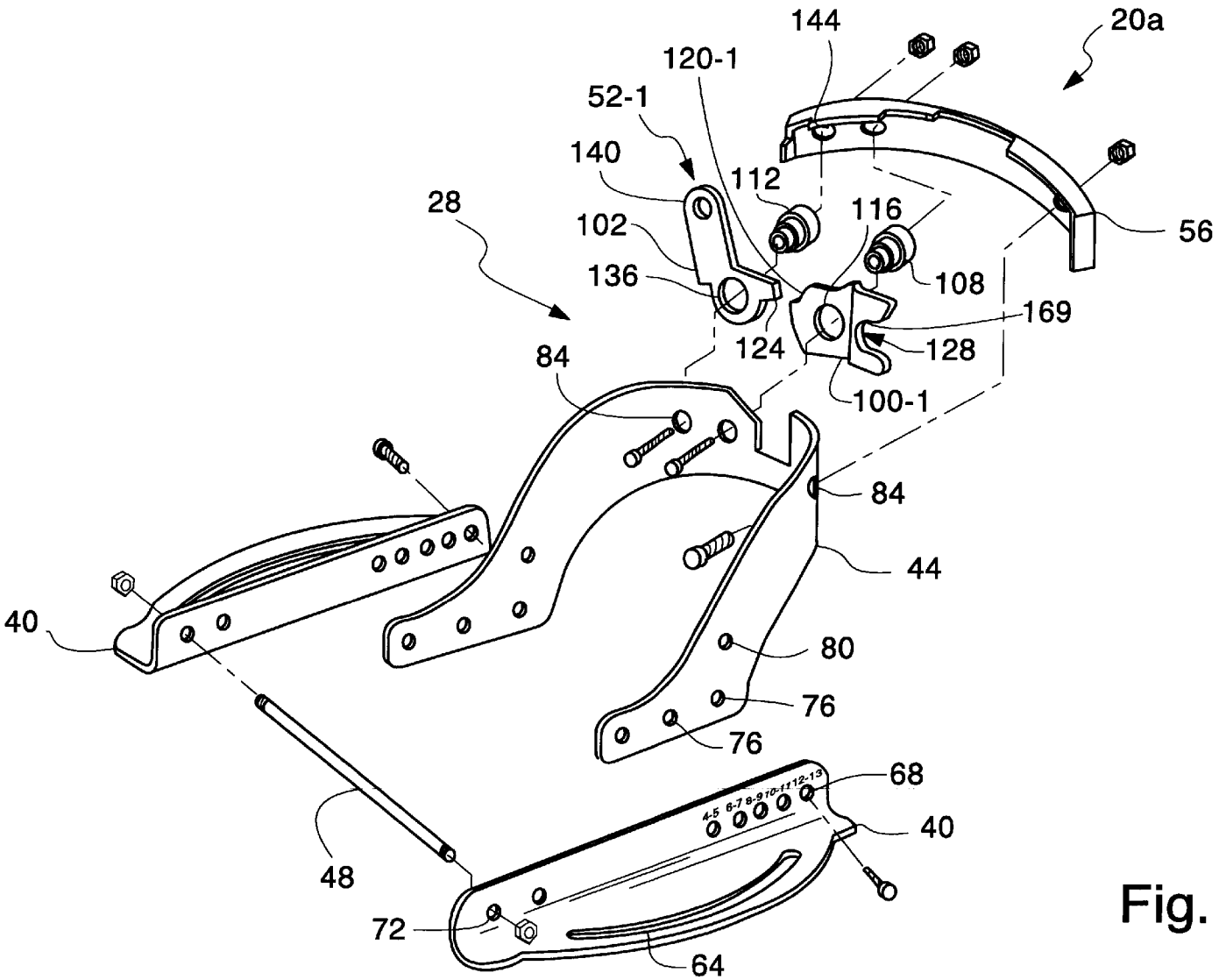
FIG. 2 is a view of the embodiment in a disassembled state.

Referring to FIGS. 1 and 2, the rear snowboard binding 20*a* includes a holding member assembly 28 for engaging the soft- or hard-shelled boot 30 (FIG. 3), binding fasteners 32 for attaching the holding member assembly 28 to the snowboard 24 (not shown in FIG. 2), and a leg support 36 for transferring forces from the leg of the snowboarder to the snowboard 24 (not shown in FIG. 2).

The holding member assembly 28 includes side members 40, an arcuate rear member 44, a restraining member 48, a locking subassembly 52, and a housing member 56. The various components are connected by screws and bolts as shown in FIG. 2 or by another suitable type of fastener.

The side members 40 are mirror images of one another. Each side member has an orientation adjustment slot 64 for adjusting the orientation of the holding member assembly 28 relative to the longitudinal axis of the snowboard 24, boot adjustment holes 68 for adjusting the holding member assembly 28 to receive the boot 30 having a desired size, and restraining member holes 72 for receiving the restraining member 48.

The arcuate rear member 44 preferably has substantially the same shape as the rear portion of the boot 30. The arcuate rear member includes boot adjustment holes 76 for aligning with the boot adjustment holes 68 on the side member 40, leg support holes 80 for attaching the leg support 36 to the arcuate member 44, and housing holes 84 for attaching the locking subassembly 52 and the housing member 56 to the arcuate member 44.

The rear portion of the arcuate member 44 is elevated above the top of the snowboard 24, preferably at least about 1 inch above the top of the snowboard 24, to prevent the arcuate member 44 from contacting the snow during edging or turning of the snowboard 24. Typically, snowboards are relatively narrow, having a width ranging from about 8 to about 14 inches. At such narrow widths, the contact of the front or rear of the snowboard binding 20*a* and the boot 30 with the snow can be a significant problem, especially during edging or turning. To narrow the length of the bindings 20*a* and 20*b* as much as possible, the rear portion of the arcuate member 44 is elevated above the snowboard 24.

Figure 3:
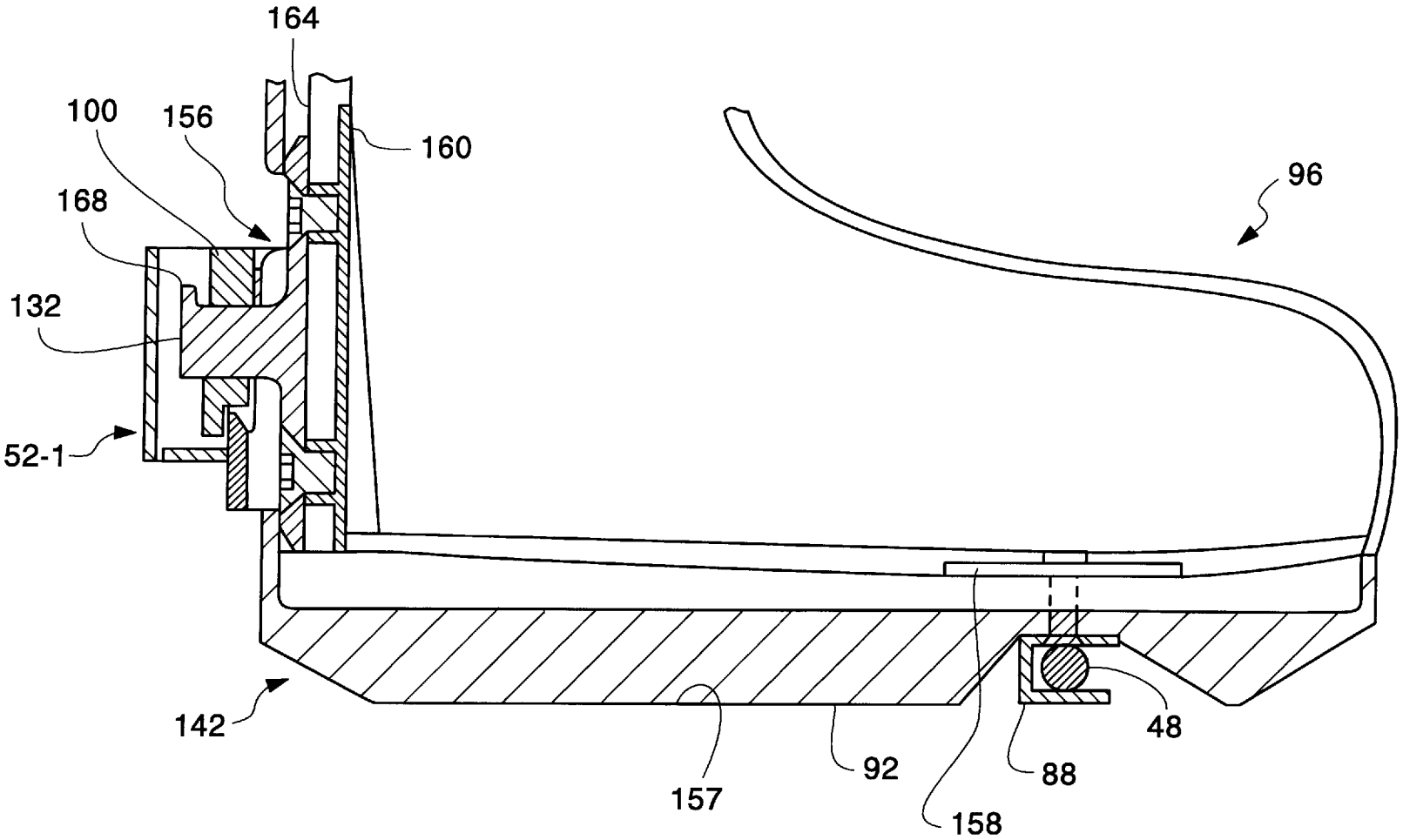
FIG. 3 is a cross-sectional view of a soft-shelled boot according to the present invention engaging the snowboard binding.

Referring to FIGS. 2 and 3, the restraining member 48 engages a hooked member 88 on the sole 92 of the boot 30 for holding a front portion 96 of the boot 30 in the holding member assembly 28. The restraining member 48 can be any suitable shape and size provided that the restraining member 48 interlocks with the hooked member 88. In the preferred embodiment, the restraining member 48 is rod-shaped and extends between the side members 40. As will be appreciated, the restraining member 48 can be any other suitable device to engage the front portion 96 of the boot 30, such as a toe clip. The restraining member 48 can be located on the snowboard 24 detached from the side members 40 to more easily accommodate different boot sizes. The holding member assembly 28 can be adjusted for a boot size simply by altering the location of the restraining member 48 relative to the side members 40.

Figure 5:
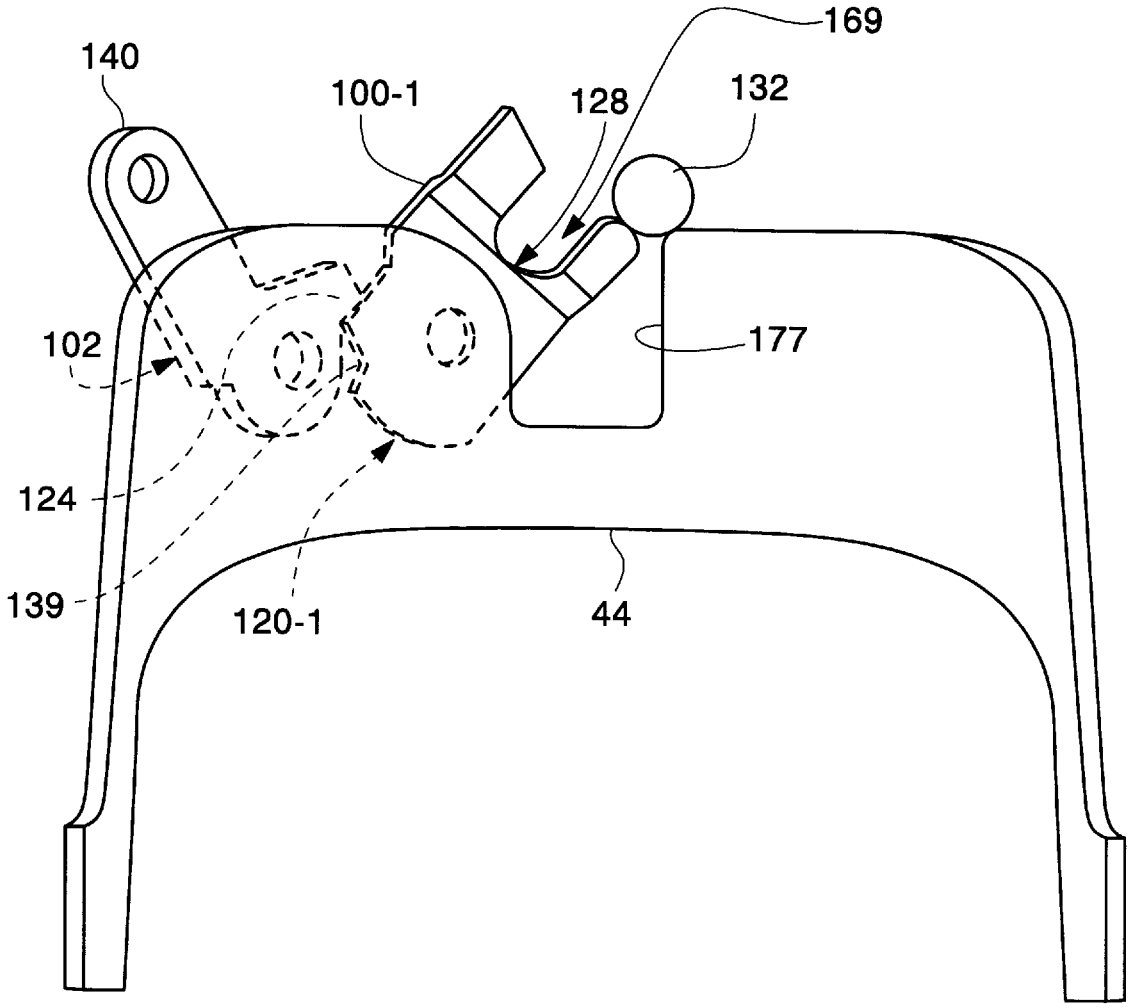
FIGS. 5–6 are views of the projection being inserted into the one embodiment of the receiving member.
Figure 6:
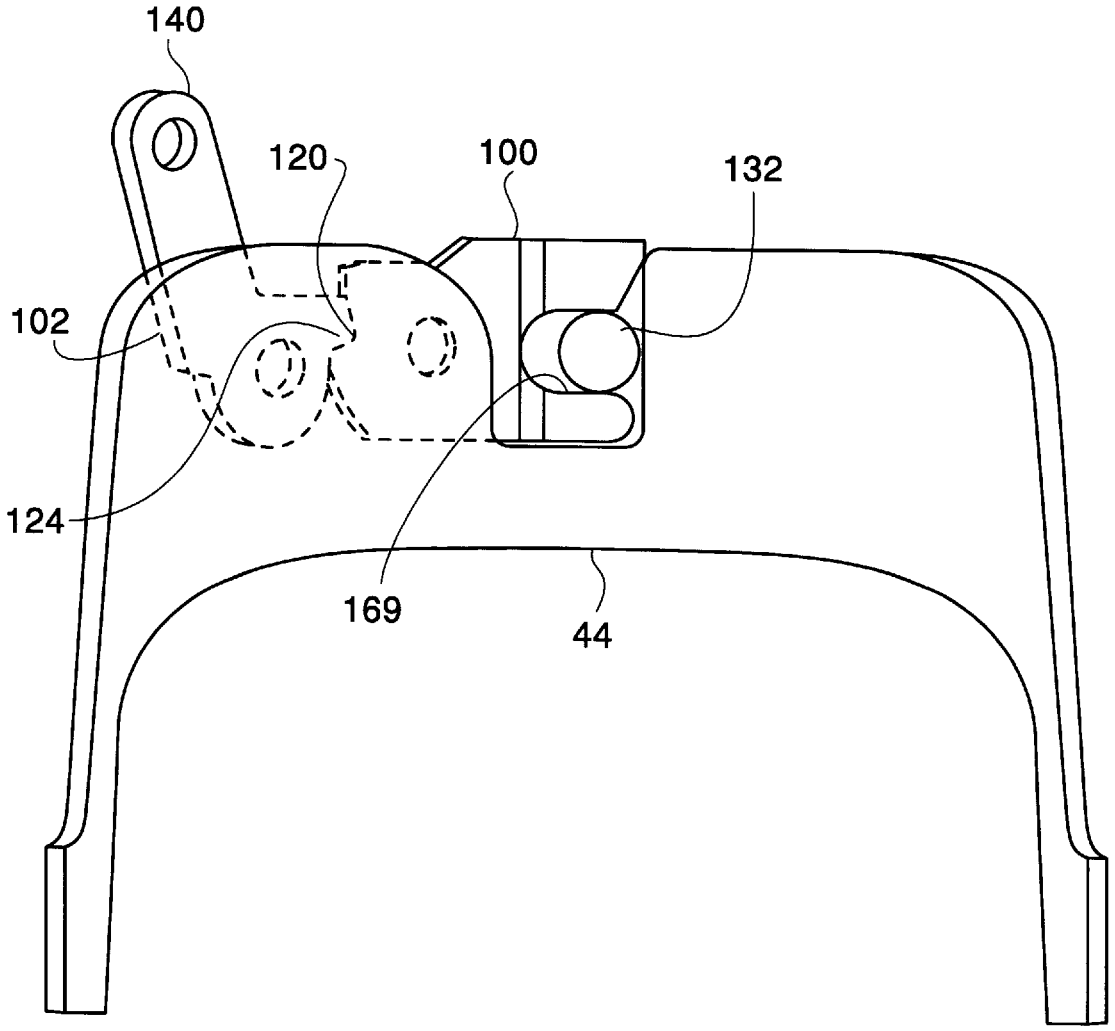

Referring to FIGS. 5 and 6, a first embodiment 52-1 of the locking subassembly 52 includes a first embodiment 100-1 of a receiving member 100 (referred to as the receiving member 100-1), a locking member 102, a receiving member bushing 108, and a locking member bushing 112. The receiving member 100-1 has a bushing hole 116 for receiving the receiving member bushing 108, a first embodiment 120-1 of a notched end 120 (referred to as the notched end 120-1) to engage an extension 124 of the locking member 102, and a slotted end 128 for receiving a projection 132 in the boot 30. The locking member 102 has a bushing hole 136 for receiving the locking member bushing 112, and has the extension 124 to engage a notch 139 of the notched end 120-1 of the receiving member 101-1, and a lever arm 140 to rotate the locking member 102 and disengage the locking member 102 from the receiving member 100-1. The locking member 102 and the receiving member 100-1 are mounted for movement on the arcuate member 44, such as for rotation, and rotate independently from one another to enable the extension 124 of the locking member 102 to engage and disengage the notch 139 of the receiving member 100-1 during use. As will be appreciated, the locking subassembly 52-1 can be a number of other suitable devices that are capable of engaging a rear structural member on the boot 30, such as the projection 132.

The first embodiment of the locking subassembly 52-1 is located at the rear of the arcuate member 44 and is thereby elevated above a top surface 141 (FIG. 1) of the snowboard 24. As noted above, the relatively narrow widths of the snowboard 24 impose limitations on the length of snowboard bindings. This problem is overcome by positioning the locking subassembly 52-1 at the rear of the arcuate member 44. In this position, the locking subassembly 52-1 is preferably located above a heel 142 of the boot 30 at a height ranging from about 1.5 to about 5 inches and more preferably from about 2 to about 5 inches above the top surface 141 of the snowboard 24. The first embodiment of the locking subassembly 52-1 is preferably not located too high above the top 141 of the snowboard 24 as it would detrimentally affect the ability to control the snowboard 24 through too much flexibility in the boot.

The housing member 56 attaches to the rear of the arcuate rear member 44 and protects the first embodiment of the locking subassembly 52-1 from damage. The housing member 56 includes attachment holes 144 for receiving bolts to attach the housing member 56 to the arcuate rear member 44.

The binding fasteners 32 are typically screws which pass through the adjustment slot 64 to engage the snowboard 24. As noted above, the adjustment slot 64 permits the holding member assembly 28 to be oriented at a desired angle relative to the longitudinal axis of the snowboard 24.

The leg support 36 increases the maneuverability of the snowboard 24 by enabling the snowboarder to exert forces on the snowboard 24. To edge and/or turn the snowboard 24, a snowboarder leans back on the leg support 36, which lifts the toe edge 148 of the snowboard. As the toe edge 148 is lifted, the heel edge 152 exerts increased force on the snow which causes the snowboard 24 to turn. The leg support 36 includes an alignment slot 38 to guide the projection 132 into the locking subassembly 52-1. The width and depth of the alignment slot 38 are sufficient to receive the projection 132.

As will be appreciated, the leg support 36 can be in a variety of heights. Low back leg supports 36 typically have a height ranging from about 5 to about 7 inches above the top surface 141 of the snowboard 24. High back leg supports 36 typically have a height ranging from about 7 to 11 inches above the top of the snowboard 24. Low back leg supports 36 are typically preferred where the snowboarder desires a greater degree of movement. High back leg supports 36 are typically preferred where the snowboarder desires a greater degree of control over the maneuverability of the snowboard 24. The leg support 36 can be eliminated from the holding member assembly 28 altogether in some applications.

Referring again to FIG. 3, the boot 30 includes the hooked member 88 located on a recessed portion of the sole 92 of the boot 30 and a projection assembly 156 on the rear of the boot 30. The hooked member 88 is recessed in the sole 92 and extends no further than a bottom 157 of the sole 92 to make walking in the boots 36 easier and allow the boot 30 to stand flat on the snowboard 24. The hooked member 88 is mounted on a backing plate 158 located in the lower surface of the boot shell 164 for securing the hooked member 88 to the boot 30. Preferably, the hooked member 88 is located on the boot 30 so that the hooked member 88 is between the middle of the snowboarder's foot and the seam of his toes. As will be appreciated, if the hooked member 88 is too close to the rear of the boot 30, entry into the holding member assembly is more difficult. Likewise, if the hooked member 88 is located too close to the toe of the boot 30, the toe of the boot 30 may contact the snow during edging or turning. As will be appreciated, the hooked member 88 can be replaced by a variety of other devices that are capable of engaging the holding member assembly 28.

The projection assembly 156 includes the projection 132 for engaging the receiving member 100-1 and a backing plate 160 located inside of the boot shell 164 for securing the projection 132 to the boot 30. The projection includes a spur 168 to prevent the projection 132 from being removed from the receiving member 100-1 when the receiving member 100 is in a locked position. The cross-sectional area of the spur 168 is greater than the cross-sectional area of the portion of the projection 132 in a slot 169 on the slotted end 128 of the receiving member 100. The spur 168 also extends vertically beyond the upper edge of the slot 169. As will be appreciated, the projection 132 can be replaced by a variety of other types of rear structural members on the boot 30 that are capable of engaging the holding member assembly 28. The backing plate 160 has a radius of curvature substantially equal to the radius of curvature of the inside of the top of the boot 30. The backing plates 158 and 160 have a sufficient area to prevent the hooked member 88 and the projection assembly 156, respectively, from being torn out of the boot 30 during use.

Referring again to FIG. 1, the receiving member 100-1 can face the same direction in both the right and left snowboard bindings 20*a* and 20*b* to simplify construction of the bindings.

Figure 4:
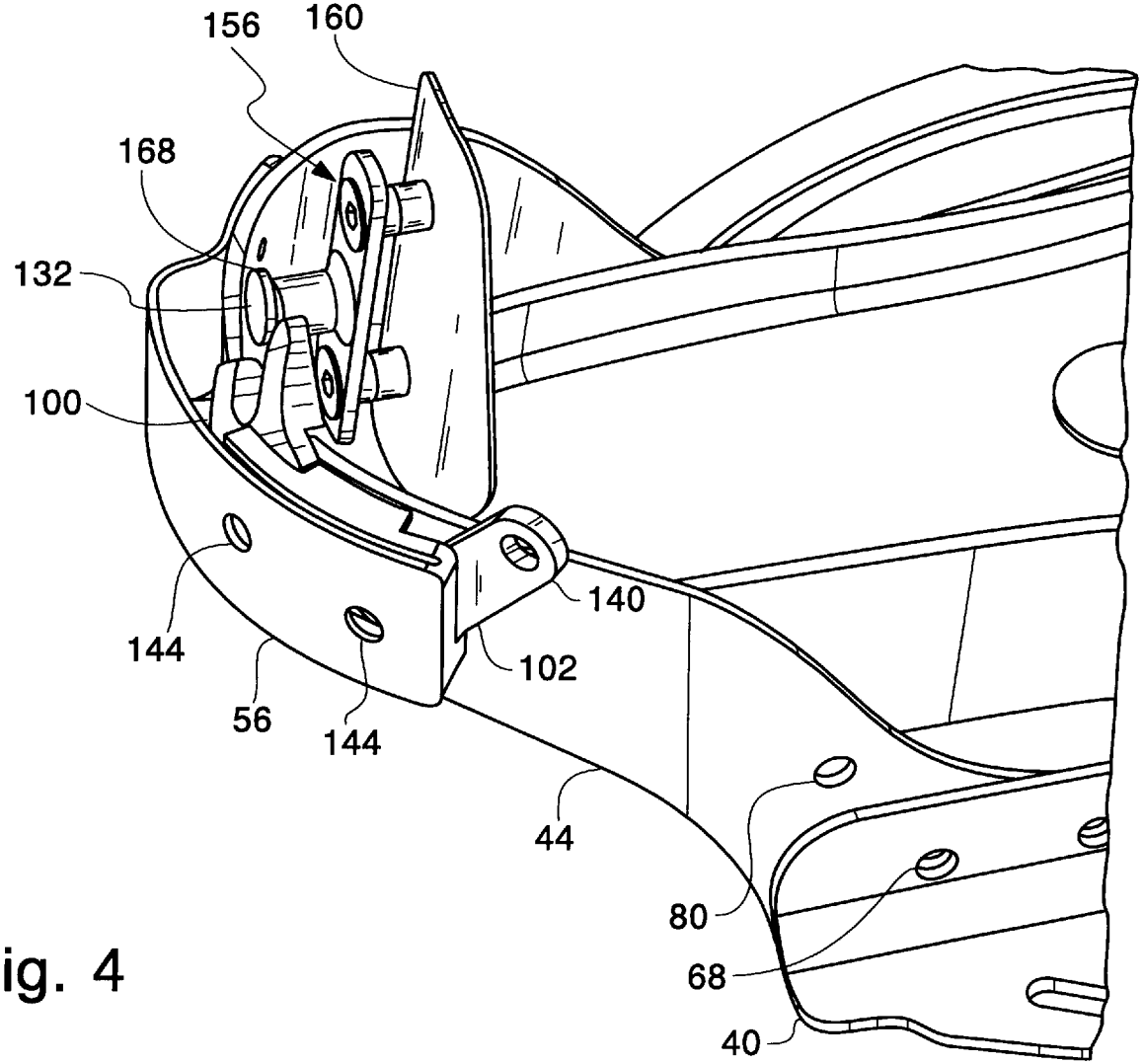
FIG. 4 is a view of the projection assembly (removed from the boot) being inserted into one embodiment of the receiving member.

The operation of the snowboard binding 20*a* is illustrated in FIGS. 4–6. The snowboard bindings 20*a* and 20*b* are first mounted on the snowboard 24 at the desired orientations relative to the longitudinal axis of the snowboard 24.

After the snowboard bindings 20*a* and 20*b* are mounted on the snowboard 24, the boots 30 are sequentially placed in a locked position in the holding member assembly 28. To place the boots 30 in a locked position, the boots 30 are engaged with the holding member assembly 28 by placing the restraining member 48 in the hooked member 88 and then placing the projection 132 into the slot 169 of the slotted end 128 of the receiving member 100-1. The boot 30 is then forced downwards towards the snowboard 24, which causes the receiving member 100-1 to rotate about the receiving member bushing 108 with the slotted end 128 moving downward into a binding position shown in FIG. 6. The extension 124 rotates about the axis of the locking member bushing 112 to engage the notch 139 of the notched end 120-1 and releasably retain the receiving member 100-1 in the locked (or binding) position.

To release the boot 30 from the holding member assembly 28, the lever arm 140 is moved downward (counter clockwise in FIG. 6) to cause the locking member 102 to rotate relative to the locking member bushing 112 and cause the extension 124 to disengage from the notch 139 of the notched end 120-1 of the receiving member 100-1. The boot 30 is forced upward to cause the disengaged receiving member 100-1 to rotate upward into an unlocked position.

Figure 8:
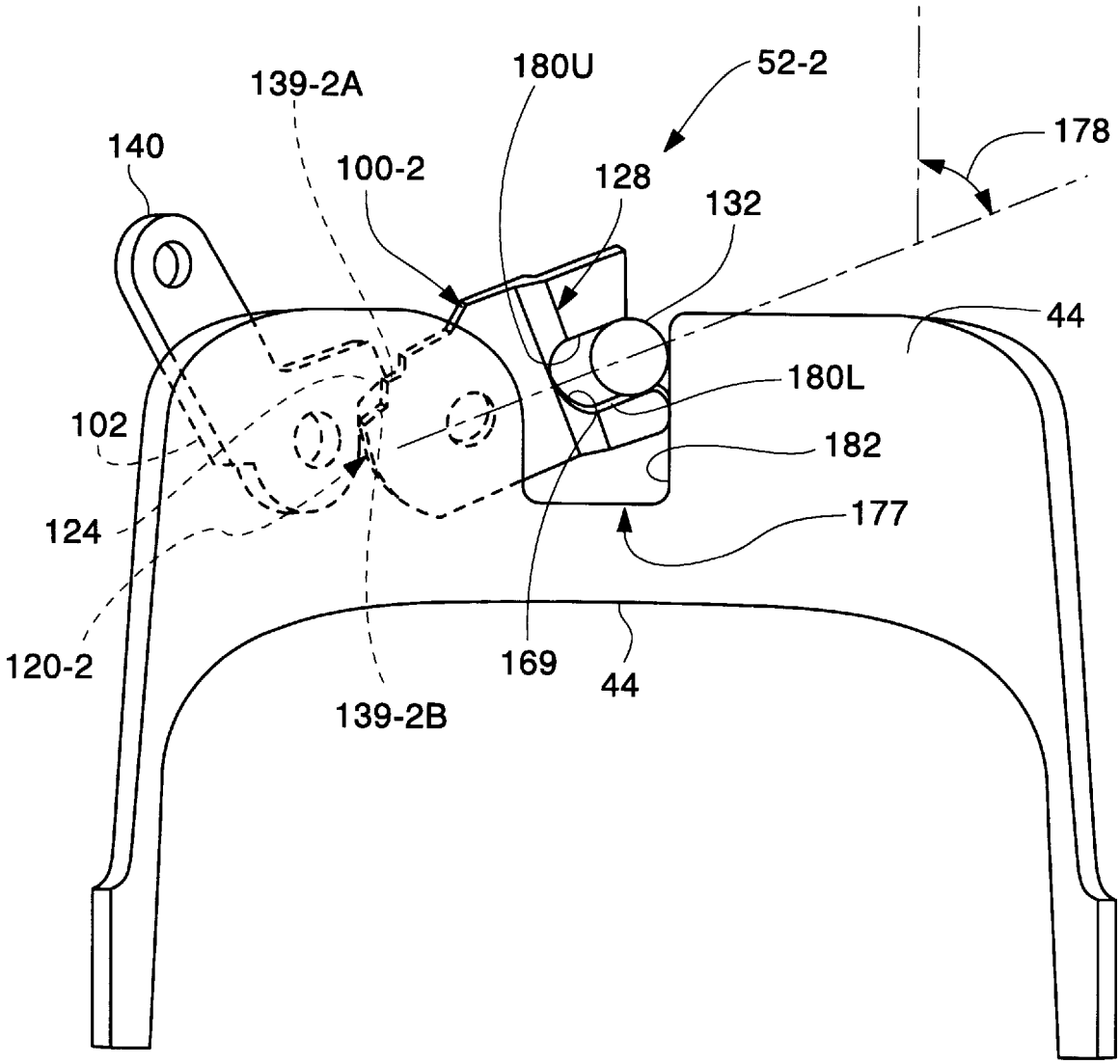
FIG. 8 is a view similar to FIG. 5 showing a second embodiment of the receiving member at a first angular position relative to an arcuate near member, wherein the projection is captured by the receiving member, and the extension of the locking member engages a first notch of a series of notches on the notched end of the receiving member.
Figure 9:
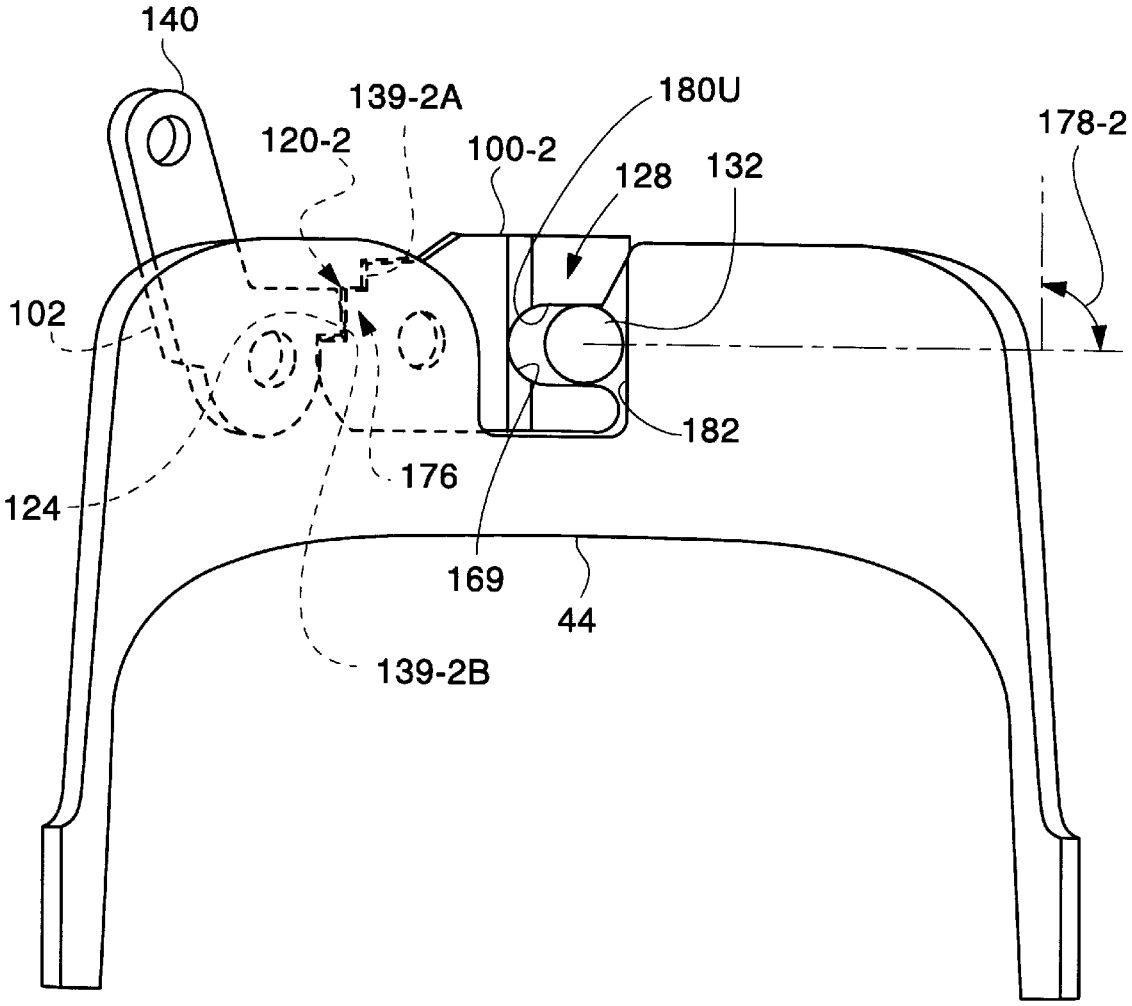
FIG. 9 is a view similar to FIG. 6 showing the second embodiment of the receiving member at a second angular position, with the projection being captured by the receiving member and the extension of the locking member engaging a second notch of the series of notches on the notched end of the receiving member.
Figure 10:
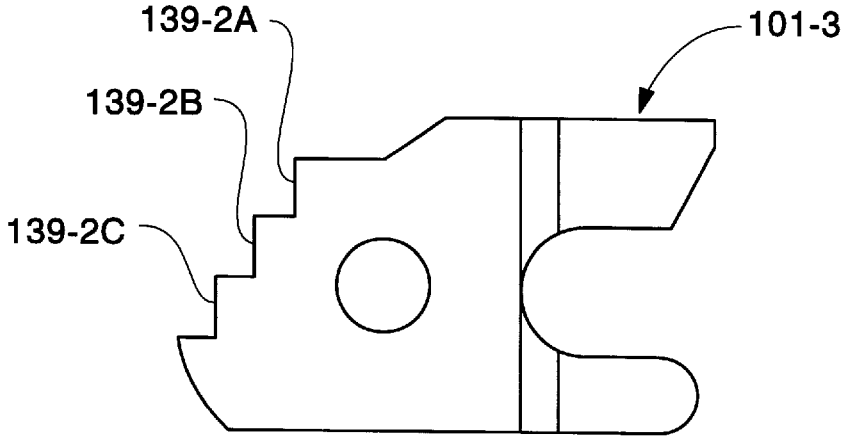
FIG. 10 is a third embodiment of the receiving member, showing the series of notches including three notches.

A second embodiment 52-2 of the locking subassembly 52 (referred to as the receiving member 52-2) includes a second embodiment 100-2 of the receiving member 100 (referred to as the receiving member 100-2), and the same other structure as is used in the first embodiment of the locking subassembly 52-1. The receiving member 100-2 also has the slot 169 of the slotted end 128. However, as shown in FIGS. 8 through 10, a second embodiment 124-2 of the notched end 124 (referred to as the notched end 124-2) is provided with a series 176 of the notches 139-2, two such notches 139-2A and 139-2B being shown in FIGS. 8 and 9, and three such notches 139-2A, 139-2B and 139-2C being shown in the series 176 in FIG. 10. The notches 139-2 may also be referred to as control surfaces.

Considering FIGS. 8 and 9 with FIG. 5, as the boot 30 is stepped into the rear binding 20*a*, the projection 132 starts to engage the receiving member 100-2 as shown in FIG. 5 for the first embodiment 100-1. The boot 30 moves downward to position the projection 132 as shown in FIG. 8 with the projection 132 in both a slot 177 of the rear arcuate member 44 and the slot 169 of the receiving member 100-2. FIG. 8 shows a minimum amount of such movement of the boot 30 and of the projection 132 necessary to capture the projection 132. This minimum amount of such movement is indicated by the angle 178 of the receiving member 100-2 in FIG. 8. Such capturing is by having upward movement of the projection 132 be blocked by the combined action of an upper surface 180U (of the slot 169) and a right wall 182 of the slot 177. To releasably retain the projection 132 as thus captured, the extension 124 cooperates with a first notch 139-2A of the notches 139-2. The first notch 139-2A is positioned relative to the axis of the retaining member 100-2 so as to be engaged by the extension 124, which prevents the retaining member 100-2 from rotating counter clockwise on its axis. With the retaining member 100-2 held against counter clockwise rotation, the projection 132 is held by the wall 182 and the upper surface 180U against upward motion. This is a first locked position of the retaining member 100-2 and corresponds to a first secure snowboarding position of the boot 30 relative to, or near, the surface 141 of the snowboard 24.

As the snowboarder rides the snowboard 24, the snow between the upper surface 141 of the snowboard 24 and the bottom of the heel 142 of the boot 30 may be dislodged, compacted, or melt, such that the boot 30 may move toward or engage the top surface 141 of the snowboard 24. Similarly, if there was no snow between the upper surface 141 and the bottom of the heel 142, the boot 30 moves toward and onto the surface 141 of the snowboard 24. This moves the projection 132 down in the slot 177 and urges the receiving member 100-2 clockwise as the projection 132 bears downwardly on a lower surface 180L of the slot 169. As the receiving member 100-2 rotates clockwise, the extension 124 rides off the first notch 139-2A and engages a second notch 139-2B as shown in FIG. 9. The boot 30 and the projection 132 are shown in FIG. 9 fully moved into a second binding position, which is a second secure snowboarding position. The receiving member 100-2 is held against counter clockwise rotation on the axis by the extension 124 engaging the second notch 139-2B, and with the upper surface 180U and the right wall 182 capturing the projection 132. The maximum amount of movement of the projection 132 is represented by the angle of the receiving member 100-2 as shown in FIG. 9 by an arrow 178-2. Thus, the extension 124 engages the notches 139-2 one-at-a time.

It may be understood that the vertical difference of the respective first and second binding positions of the projection 132, or secure snowboarding positions, shown in respective FIGS. 8 and 9 is measured in fractions of an inch. This difference reflects the amount of snow, for example, that may be between the upper surface 141 of the snowboard 24 and the bottom of the heel 142 of the boot 30 and still result in binding action as the snowboarder attempts to move the boot 30 fully into the second binding position shown in FIG. 9. Because of the series 176 of the notches 139-2, and the positioning of the notch 139-2A to be engaged by the extension 124 just as the surface 180U and the right wall 182 capture the projection 132, the boot 30 need not be moved fully onto the top surface 141 of the snowboard 24 in order to bind the boot 30 to the snowboard 24. Rather, the first notch 139-2A and the extension 124 cooperate to produce the binding action in the first binding position.

FIG. 10 shows a further embodiment of the receiving member 100-3, in which the series 176 of notches 139 includes three notches 139-2A, 139-2B and 139-2C, for example. The notches 139 cooperate with the extension 124 in the same manner as the notches 139-2, but allow the extension 124 to hold the receiving member 101-3 against counter clockwise rotation after smaller amounts of vertical motion of the projection 132, as compared to FIGS. 8 and 9. In the event that more notches 139 are preferred, then more than two or three notches 139 may be provided, all in the manner shown in FIGS. 8–10.

Figure 7:
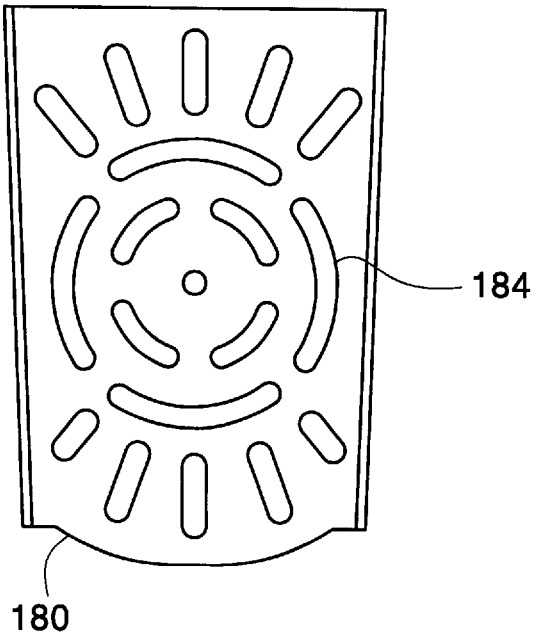
FIG. 7 is a view of another embodiment of the present invention.

An alternative embodiment is depicted in FIG. 7. FIG. 7 depicts the snowboard binding 20*a* with a solid base plate 180 rather than two separate side members 40. The base plate 180 includes orientation adjustment slots 184, boot adjustment holes, and restraining member holes.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims.

What is claimed is:

1. A snowboard binding system for receiving a boot in secured positions relative to a surface of a snowboard, the boot having a front portion, a rear portion, and a structural member on the rear portion, said system comprising:

front and rear members for engaging the boot;

means on said front member for engaging the front portion of the boot; and means on said rear member for holding the rear portion of the boot, said means for holding comprising:

a receiving member for releasably engaging the structural member, said receiving member being movably mounted on said rear member for movement between a disengaged position, a first locked position, and a second locked position; and a locking member movably mounted on said rear member, said locking member separately engaging said receiving member in each of the first and second locked positions to lock the boot in said binding system and disengaging said receiving member for movement of said receiving member to the disengaged position to release the boot from said binding system;

wherein said means for holding releasably engages the structural member to hold the boot in the secured positions.

2. The snowboard binding system according to claim 1, further comprising:

said receiving member having a first end provided with a slot for releasably receiving the structural member in each of the first and second locked positions, said receiving member having a second end provided with a series of notches, one said notch corresponding to each of the first and second locked positions; and said mounting of said locking member enabling said locking member to engage one of said notches and releasably hold said receiving member in the first locked position with the structural member captured by said slot, and to engage another of said notches and releasably hold said receiving member in the second locked position with the structural member captured by said slot.

3. A snowboard binding system for receiving a boot in secured positions adjacent to a surface of a snowboard, the boot having a front portion, a rear portion, and a structural member on the rear portion, said system comprising:

front and rear members for engaging the boot;

means on said front member for engaging the front portion of the boot; and means on said rear member for holding the rear portion of the boot, said means for holding comprising:

a receiving member for releasably engaging the structural member, said receiving member being rotatably engaged on said rear member and movable between separate first and second locked positions and a disengaged position; and a locking member rotatably engaged on said rear member, said locking member separately engaging said receiving member in each of the first and second locked positions to lock the boot in said binding system and disengaging said receiving member for movement of said receiving member to the disengaged position to release the boot from said binding system;

wherein said means for holding releasably engages the structural member to hold the boot in the secured positions.

4. The snowboard binding system according to claim 3, further comprising:

said receiving member having an end engaged by said locking member, said end being provided with a series of separate notches, each of said notches corresponding to one of said first and second locked positions; and said engagement by said locking member of said receiving member being engagement with separate ones of said notches.

5. A snowboard binding system for receiving a boot in secured positions on a surface of a snowboard, said boot having a front portion, a rear portion, and a structural member on the rear portion, said binding system comprising:

the structural member comprising a projection extending from the boot;

front and rear members for engaging the boot;

means on said front member for engaging the front portion of the boot; and means on said rear member for holding the rear portion of the boot, said means for holding comprising:

a receiving member having a slot for receiving said projection, said receiving member being rotatably mounted on said rear member to position said slot to retain said projection in either a first or a second locked position, said receiving member having first and second notches, each of said notches corresponding to one of the locked positions; and a locking member rotatably engaged on said rear member, said locking member being rotatable for selectively engaging said first notch or said second notch of said receiving member to lock the boot either in the first or the second locked position and for disengaging from said receiving member to release the boot from said binding system;

wherein said means for holding releasably engages the structural member to hold the boot in the secured positions.

6. A snowboard binding system for receiving a boot in a plurality of secure snowboarding positions on a surface of a snowboard, said boot having a front portion, a rear portion, and a structural member on said rear portion, said binding system comprising:

said structural member comprising a projection extending from said rear portion of said boot;

front and rear members for engaging said boot;

means on said front member for engaging said front portion of said boot; and means on said rear member for holding said rear portion of said boot, said means for holding comprising:

said rear member having a first slot provided with a bottom and an open top for receiving said projection in a plurality of locked positions between said top and said bottom;

a receiving member having a second slot for capturing said projection received in said first slot in any of the locked positions, said receiving member being mounted for rotation on said rear member to move said second slot and capture said projection in said first slot with said boot in any of the plurality of secure snowboarding positions; and a locking member movably mounted on said rear member for Selectively locking said receiving member in each of the plurality of locked positions.

7. The snowboarding system according to claim 6, further comprising:

said receiving member having a position control end opposite to said second slot, said end being provided with a plurality of control surfaces, one said control surface corresponding to each of said secure snowboarding positions; and a position control member mounted for rotation on said rear member into engagement with different ones of said control surfaces to prevent rotation of said receiving member and retain said projection releasably captured in said first and second slots to selectively hold said boot in the plurality of secure snowboarding positions.

8. A snowboard binding for releasably securing a back of a soft-shell snowboard boot adjacent to a heel edge of a snowboard in selected secure positions, said heel edge being parallel to a longitudinal axis of said snowboard, said back of said boot having a plate fixed thereto, said plate supporting a generally horizontal rod extending away from the longitudinal axis and past said back of said boot to a terminus vertically aligned with said heel edge of said snowboard, said binding comprising:

a back binding member secured to said top surface of said snowboard, said back binding member having a back retainer section extending up from said top surface of said snowboard to a position above said heel edge of said snowboard, said back retainer section having a latch section extending generally vertically and being provided with a first slot having a closed end and an open end opposite to said closed end, said open end of said slot facing upwardly to receive said rod when said bottom of said heel of said boot is on or near said top surface of said snowboard with said back in any of the secure positions and said rod in any of a plurality of selected locked positions;

a latch member for receiving and engaging said rod, said latch member being movably mounted on said latch section for movement between a plurality of locking positions for closing said open end of said first slot of said latch section and releasably preventing said rod positioned in any of the selected locked positions in said first slot from moving out of said open end of said first slot to releasably secure said back of said boot to said back binding member in any of the selected secure positions, said latch having a series of movement control surfaces, one such surface being for each of the locking positions, said latch being movable into an unlocked position for opening said open end of said first slot and permitting said rod to move out of said first slot to release said rod from said binding; and a latch control member movably mounted on said latch section to selectively engage said control surfaces and releasably control movement of said latch member in the locking positions to hold said rod in any of the selected locked positions and disengage from said control surfaces to permit said latch member to move into the unlocked position.

9. A binding system for holding a boot in any of a plurality of secured positions on or near a surface of a snowboard having opposite side edges, said boot having a toe portion, a heel portion and a back portion, said binding system comprising:

front and rear members for engaging said boot, said rear member being secured to and extending from said surface between said side edges to define an arcuate vertical section having a notch;

means on said front member for securing said toe portion of said boot on said surface between said side edges; and a coupling cooperating with said arcuate vertical section of said rear member and said back portion for holding said heel portion of said boot releasably secured relative to said surface in any of the plurality of secured positions on or near said surface of said snowboard, said coupling comprising;

an elongated rod, a receiving member for releasably receiving said rod and a latch for releasably locking said receiving member; said rod extending from said back portion of said boot through said notch a into said receiving member, said receiving member being mounted on said arcuate vertical section and being movable between a first position disengaged from said rod and a plurality of locked positions in which said rod is in any of many rod positions in said notch and said receiving member engages said rod in any of the rod positions for releasably securing said rod to said arcuate vertical section of said rear member; said receiving member having a latch surface for each of the locked positions, said latch being movable on said vertical section to selectively engage one of said latch surfaces and releasably hold said receiving member in one of the locked positions and hold said boot in one of the secured positions.

10. The binding system according to claim 9, further comprising:

said receiving member having a first end provided with said latch surfaces and a second end opposite to said first end, said second end having a slot for receiving said rod, said latch surfaces being positioned on said receiving member so that said slot receives and captures said rod in said notch when said latch engages any of said latch surfaces, said rod captured by said slot corresponding to said boot being in one of said secured positions on or near said surface of said snowboard.

11. A snowboard binding system for receiving a boot, said boot having a front portion, a rear portion, and a structural member extending from the rear portion, said system being secured to a surface of a snowboard, said system comprising:

front and rear members for engaging the boot;

means on said front member for engaging the front portion of the boot; and means on said rear member for holding the rear portion of the boot, said means for holding releasably engaging the structural member to hold the boot in any of a plurality of locked positions, said means for holding further comprising a receiving member for receiving and engaging the structural member and being rotatably mounted on said rear member, and a locking member rotatably mounted to said rear member, said receiving member having a rotation limiter surface corresponding to each of the plurality of locked positions, and said locking member selectively engaging one of said rotation limiter surfaces to lock said boot in said binding system at one of the locked positions, said locking member disengaging said receiving member to release the boot from said binding system.

12. A snowboard binding system according to claim 11, further comprising:

said receiving member having a pivot on which said receiving member rotates on said rear member;

a first end of said receiving member engaging the structural member when the boot is in any of the locked positions;

said first end of said receiving member being in a different angular position on said pivot for each of the locked positions;

a second end of said receiving member being on an opposite side of said receiving member from said first end, said second end being provided with said rotation limiter surfaces; and one of said limiter surfaces being provided on said second end at a location corresponding to one of the angular positions of said first end so that for every angular position in which said first end engages the structural member there is a corresponding one of said limiter surfaces.

* * * * *